United States Patent [19]

Fujita

[11] Patent Number: 4,809,577

[45] Date of Patent: Mar. 7, 1989

[54] APPARATUS FOR GENERATING TONES BY USE OF A WAVEFORM MEMORY

[75] Inventor: Kao Fujita, Hamamatsu, Japan

[73] Assignee: Yamaha Corporation, Hamamatsu, Japan

[21] Appl. No.: 91,425

[22] Filed: Aug. 31, 1987

[30] Foreign Application Priority Data

Sep. 5, 1986 [JP] Japan ..... 61-209017

[51] Int. Cl.[4] ..... G10H 7/00

[52] U.S. Cl. ..... 84/1.01; 84/1.28; 381/51; 364/419; 364/718

[58] Field of Search ..... 84/1.01, 1.03, 1.28; 381/51; 364/419, 718

[56] References Cited

U.S. PATENT DOCUMENTS 4,622,877 11/1986 Strong ..... 84/1.01

4,641,564 2/1987 Okamoto ..... 84/1.01 X

*Primary Examiner*—Stanley J. Witkowski

*Attorney, Agent, or Firm*—Spensley, Horn, Jubas & Lubitz

[57] ABSTRACT

A tone generating apparatus comprises at least an address generator, a waveform memory and a sound system. The waveform memory provides a plurality of storing areas each of which stores word data of N bits. Amplitude data of M bits (where M denotes as $N<M\leqq 1.5N$) of two sampling points are pre-stored in these storing areas in order to raise the utility efficiency of the waveform memory. Then, the word data stored in each storing area are sequentially read out from the waveform memory in a predetermined order based on the addresses generated by the address generator, and the amplitude data of two sampling points are reproduced by use of three word data stored in three storing areas. As a result, the tone corresponding to the reproduced amplitude data is generated in the sound system.

9 Claims, 6 Drawing Sheets

APPARATUS FOR GENERATING TONES BY USE OF A WAVEFORM MEMORY

BACKGROUND OF THE INVENTION

1. Field of the Invention

The present invention generally relates to apparatuses for generating tones by use of a waveform memory, and more particularly to an apparatus which generates tones such as tones of percussion instruments by using a waveform memory efficiently.

2. Prior Art

In a conventional apparatus for generating tones such as a rhythm performance apparatus, each waveform data corresponding to each percussion instrument (such as a drum and a cymbal) are pre-stored in a waveform memory and the stored waveform data are selectively read out from the waveform memory, whereby such apparatus can play the rhythm performance. Before such a process, a player actually plays the percussion instruments so as to obtain the tones of the percussion instruments (percussive tones), and the waveforms of the percussive tones are sampled and converted into amplitude data by use of an analog-to-digital converter. The amplitude data are used as the above waveform data. For example, the amplitude data of eight bits are obtained at each sampling point. Usually, such amplitude data of eight bits are stored in the waveform memory, the bit number of one word (the one word bit number) of which is eight bits. Hence, one amplitude data at one sampling points (hereinafter, referred to as one sampling data) are assigned to one word storing area of the waveform memory.

In the above apparatus, the one word bit number of the waveform memory must be increased when the bit number of one sampling point (one sampling bit number) is increased. In order to improve the fidelity corresponding to the percussive tone source, it is necessary to increase the one sampling bit number. In some cases, it is preferable that one sampling bit number is set to twelve bits, for example. In this case, it is required to use a waveform memory in which the one word bit number is set to more than twelve bits. Hence, the conventional tone generating apparatus suffers a problem in that the cost thereof must be raised.

In order to solve the above problem, it can be considered to employ a method in which one sampling data are assigned to two-word storing area of the waveform memory. In this case, one sampling bit number is eight bits and the two-word bit number of the waveform memory is equal to sixteen bits (because one word bit number is eight bits), hence, four-bit storing area is remained not to be used at each two-word storing area of the waveform memory. Therefore, this method is disadvantageous in that an utilization efficiency of the waveform memory is relatively low.

In addition, specific waveform memory portion must be provided for storing noisy tones in the conventional waveform memory because plural waveform data are stored for each musical instrument. Hence, the conventional apparatus suffers another problem in that the storage capacity of the waveform memory must be increased.

SUMMARY OF THE INVENTION

It is accordingly the primary object of the present invention to provide an apparatus for generating tones by use of a waveform memory, in which the data storing format is improved so as to raise the utilization efficiency of the waveform memory.

It is another object of the present invention to provide an apparatus for generating tones in which the musical tones can be stored and reproduced with less storage capacity of the waveform memory and with less distortion rate as well.

It is a further object of the present invention to provide an apparatus for generating noisy tones which can be realized with relatively low price without having to provide a specific waveform memory portion from the waveform memory.

In a first aspect of the invention, there is provided an apparatus for generating tones by use of a waveform memory comprising: (a) waveform memory means for storing amplitude data of M bits (where M denotes an integral number) based on a predetermined data storing format, the waveform memory means comprising a plurality of one-word storing areas each of which is constructed by N-bit storing positions (where N denotes an integral number and sets as $N<M\leqq 1.5N$); (b) address supplying means for supplying addresses indicating each of the one-word storing areas in a predetermined order to the waveform memory means, so that new amplitude data of N bits are read out based on the amplitude data of M bits; (c) tone generating means for generating a tone corresponding to the new amplitude data.

In a second aspect of the invention, there is provided an apparatus for generating tones by use of a waveform memory comprising: (a) waveform memory means for storing amplitude data of M bits (where M denotes an integral number) based on a predetermined data storing format, the waveform memory means including a plurality of storing areas each of which stores data of N bit storing positions (where N denotes an integral number and sets as $N<M\leqq 1.5N$) as one word; and (b) selecting means for selecting one of a first tone corresponding to the tone waveform stored in the waveform memory means and a second tone corresponding to a tone different from the tone waveform; (c) address generating means for generating a first address when the selecting means select the first tone and generating a second address when the selecting means select the second tone; and (d) tone generating means for generating selected first or second tone, the tone generating means reading out word data of N bits from each storing area of the waveform memory means based on the first address and reproducing the amplitude data of M bits at each sampling point by use of a plurality of the word data so as to generate the first tone corresponding to reproduced amplitude data when the selecting means select the first tone, the tone generating means reading out the word data of N bits from each storing area of the waveform memory means based on the second address so as to generate the second tone by use of the word data when the selecting means select the second tone.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF THE PREFERRED EMBODIMENT

Figure 1:
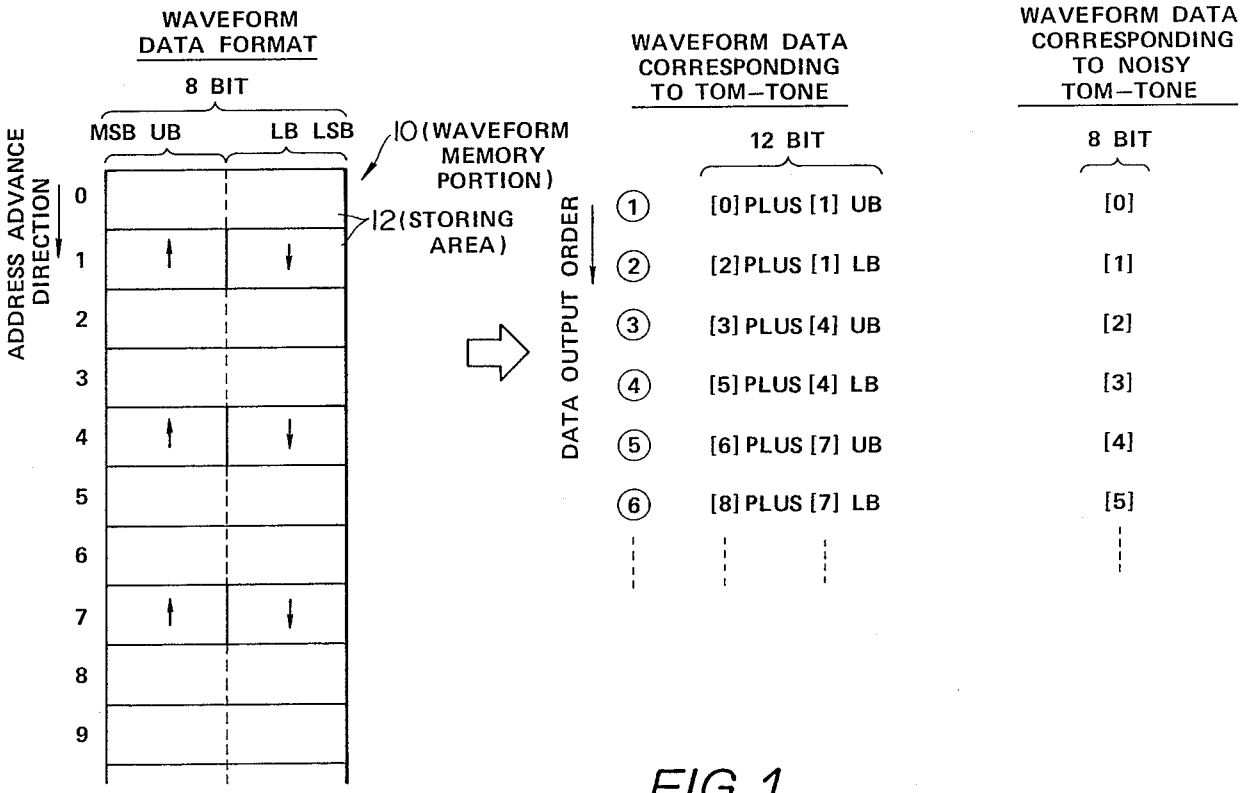
FIG. 1 is a conceptual diagram for explaining a diagrammatic process for generating different waveforms according to the present invention.

Referring now to the drawings, wherein like reference characters designate like or corresponding parts throughout the several views.

Next, description will be given with respect to the diagrammatic process for generating different waveforms in conjunction with FIG. 1. In this case, one word bit number N is set to eight, and one sampling bit number M is set to twelve.

In a waveform memory portion 10 provided with a plurality of storing areas, each storing area 12 can store data of eight bits as one word data. These storing areas are disposed in a address advance direction. In addition, each storing area of each address can be divided into two portions, i.e., an upper storing portion UB and a lower storing portion LB.

For example, the plural storing areas are supplied with the amplitude data, one sampling bit number of which is twelve bits. The amplitude data are sequentially generated in an order corresponding to a sampling order of tom-tone (percussive tone) waveforms. Thus, the amplitude data are stored based on a predetermined data storing format.

More specifically, the lower eight bits of the first amplitude data of twelve bits are stored in the storing area of address "0", and the upper four bits of the first amplitude data are stored in the upper storing portion UB within the storing area of address "1". Next, the upper four bits of the second amplitude data of twelve bits are stored in the lower storing portion LB within the storing area of address "1", and the lower eight bits of the second amplitude data are stored in the storing area of address "2".

Similar to the above storing process, the amplitude data of twelve bits are sequentially stored in the storing areas, each of which can stores the data of eight bits. As a result, the amplitude data of two sampling points (i.e., the data of twenty-four bits) are stored in three storing areas (which can store the data of twenty-four bits). In such a data storing format, it is possible to eliminate un-used storing portions within the storing areas of addresses "1", "4" and "7" etc.

The waveform memory portion 10 is originally used for reproducing the tom-tones, however, it is possible to generate the noisy tom-tones (e.g., the tom-tones including noises) in the present embodiment.

In the case where the waveform data corresponding to the tom-tones are generated, the data of eight bits are read out from each storing area 12 within the waveform memory portion 10, and this data of eight bits are combined together so as to reproduce the waveform data of twelve bits at each sampling point as shown in the middle part of FIG. 1.

More specifically, data [0] stored in the storing area of address "0" are combined with data [1]UB stored in the upper storing portion UB within the storing area of address "1" to thereby reproduce first sampling data of twelve bits. Next, data [1]LB stored in the lower storing portion LB within the storing area of address "1" are combined with data [2] stored in the storing area of address [2] to thereby reproduce second sampling data of twelve bits. Similarly, the third sampling data and the like are sequentially reproduced.

In the case where the waveform data corresponding to the noisy tom-tones are generated, the data of eight bits are sequentially read out from each storing area 12 within the waveform memory portion 10 so as to reproduce data [0] of address "0", data [1] of address "1" and data [2] of address "2" etc., as shown in the right part of FIG. 1. In this case, each of data [0] to [2] are identical to the data of eight bits read from each storing area 12 within the waveform memory portion 10. This read-out process is identical to the usual read-out process, and this read-out process can be operated with great ease.

Next, description will be given with respect to the circuit constitution of a rhythm performance apparatus according to the present invention in conjunction with FIG. 2. This rhythm performance apparatus employs a manual operating system, and it is possible to generate the tom-tones and the noisy tom-tones based on the process shown in FIG. 1.

Figure 2:
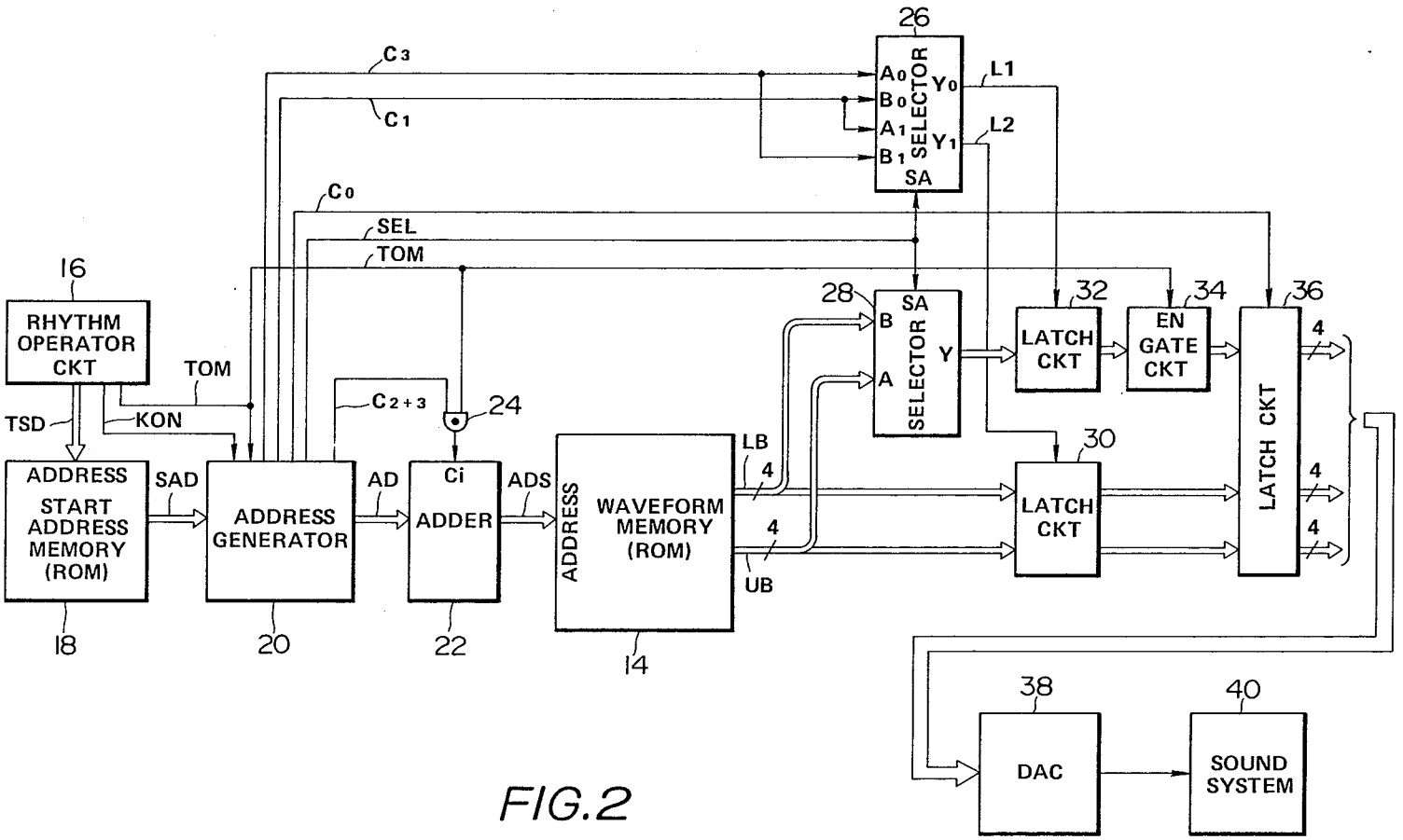
FIG. 2 is a block diagram showing a circuit constitution of an embodiment of the present invention.

In FIG. 2, a waveform memory 14 for storing percussive tones is constituted by a read only memory (ROM), and the waveform memory 14 includes a lot of storing areas, each of which corresponds to each percussive tone. In addition, each storing area can store waveform data corresponding to each percussive tone. Further, the memory portion of the waveform memory 14 can be divided into two portions, i.e., a non-tom waveform memory portion (for storing waveform data of percussive tones other than those of tom-tones) and a tom waveform memory portion (for storing waveform data of tom-tones).

More specifically, one sampling bit number of eight bits is assigned to one word storing area and the waveform data of eight bits are stored in one word storing area within the non-tom waveform memory portion. On the other hand, the waveform data of tom-tones are stored in the tom waveform memory portion as described in FIG. 1. As described before, the noisy tom-tones are generated based on the waveform data of tom-tones, therefore, there is no specific waveform memory portion for storing the noisy tom-tones provided within the waveform memory 14.

A rhythm operator circuit 16 includes plenty of rhythm operators (e.g., self-reset push button switches), each of which corresponds to each percussive tone. When each rhythm operator is depressed, the rhythm operator circuit 16 outputs tone selecting data TSD and a key-on signal KON corresponding to the depressed rhythm operator. This key-on signal KON instructs the rhythm performance apparatus to generate the percussive tones. The tone selecting data TSD select the percussive tone corresponding to the depressed rhythm operator, and this tone selecting data TSD are supplied to a start address memory 18 as an address signal. When the rhythm operator corresponding to the tom-tone is depressed, the rhythm operator circuit 16 outputs a tom-tone selecting signal TOM in addition to the tone selecting data TSD and the key-on signal KON. This tom-tone selecting signal TOM is used for controlling the process for reproducing the data of twelve bits at each sampling point.

The start address memory 18 is constituted by the ROM, for example. This start address memory 18 stores each start address data corresponding to each storing area within the waveform memory 14. Start address data SAD are read out from the start address memory 18, and the start address data SAD are supplied to an address generator 20. This start address data SAD designate the start address of the storing area corresponding to the percussive tone which is selected by the tone selecting data TSD.

The address generator 20 generates address data AD and control signals $C_0$, $C_1$, $C_3$, $C_{2+3}$ and SEL based on the start address data SAD, the key-on signal KON and the tom-tone selecting signal TOM. The detailed constitution of the address generator 20 will be described later in conjunction with FIG. 3.

The address data AD are supplied to an adder 22 wherein address data ADS for reading out waveform data are generated. When the value of the tom-tone selecting signal TOM is "1", the adder 22 is supplied with the control signal $C_{2+3}$ (as a carry input $C_i$) via an AND gate 24. On the other hand, when the value of the tom-tone selecting signal TOM is "0", the address data AD are directly passed through the adder 22 and are used as the address data ADS.

The address data ADS are supplied to the waveform memory 14 wherein each waveform data (each one word data) designating the percussive tone corresponding to the depressed rhythm operator are read out therefrom. This one word data (of eight bits) consist of lower data LB of four bits and upper data UB of four bits. In the tom-tone waveform data, the amplitude data of twelve bits must be reproduced at each sampling point. This reproduction process can be realized by use of a certain circuit portion including selectors 26 and 28, latch circuits 30, 32 and 36, and gate circuit 34.

The selector 26 receives the control signal SEL as a selecting signal SA. In a first case, the selector 26 selects the control signal $C_3$ (inputted into an input terminal $A_0$ thereof) when the value of the selecting signal SA is "1", and the selector 26 selects the control signal $C_1$ (inputted into an input terminal $B_0$ thereof) when the value of the selecting signal SA is "0". In this first case, the selector 26 outputs a first latch signal L1 from an output terminal $Y_0$ thereof. On the other hand, in a second case, the selector 26 selects the control signal $C_1$ (inputted into an input terminal $A_1$ thereof) when the value of the selecting signal SA is "1", and the selector 26 selects the control signal $C_3$ (inputted into an input terminal $B_1$ thereof) when the value of the selecting signal SA is "0". In this second case, the selector 26 outputs a second latch signal L2 from an output terminal $Y_1$ thereof.

The selector 28 receives the control signal SEL as the selecting signal SA. The selector 28 selects and outputs the upper data UB of four bits (inputted into an input terminal A thereof) from an output terminal Y when the value of the signal SA is "1". On the other hand, the selector 28 selects and outputs the lower data LB of four bits (inputted into an input terminal B thereof) from the output terminal Y when the value of the signal SA is "0".

The latch circuit 30 latches the lower data LB of four bits and the upper data UB of four bits based on the latch signal L2, and the latch circuit 30 outputs the data of eight bits to the latch circuit 36.

The latch circuit 32 latches and outputs the output data of four bits from the selector 28. When the tom-tone waveform data are read out from the waveform memory 14, the latch circuit 32 sequentially outputs the data [1]UB, [1]LB, [4]UB, [4]LB, . . .

The gate circuit 34 receives the tom-tone selecting signal TOM as an enable signal EN. When the value of this enable signal EN is "1" (i.e., when the tom-tone waveform data are read out from the waveform memory 14), the gate circuit 34 is turned on and the output data of the latch circuit 32 are supplied to the latch circuit 36 via the gate circuit 34.

The latch circuit 36 latches the output data of eight bits from the latch circuit 30 and the output data of four bits from the gate circuit 34 based on the control signal $C_0$ so that the latch circuit 36 can output data of twelve bits. When the tom-tone waveform data are read out from the waveform memory 14, the latch circuit 36 outputs the amplitude data of twelve bits. On the other hand, when the waveform data other than the tom-tone waveform data are read out from the waveform memory 14, the gate circuit 34 is turned off, hence, the amplitude data of eight bits from the latch circuit 30 are only outputted via the latch circuit 36. Meanwhile, the latch operation for the output data of the waveform memory 14 will be described later in conjunction with FIG. 6.

The amplitude data of eight bits or twelve bits from the latch circuit 36 are supplied to a digital-to-analog converter (DAC) 38 wherein the amplitude data are converted into an analog signal. This analog signal is supplied to a sound system 40. As a result, the sound system 40 generates the percussive tone corresponding to the depressed rhythm operator. Thus, the manual rhythm performance can be played by the player.

Next, description will be given with respect to the address generator 20 in detail in conjunction with FIGS. 3 and 4(*a*) to (*k*).

Figure 3:
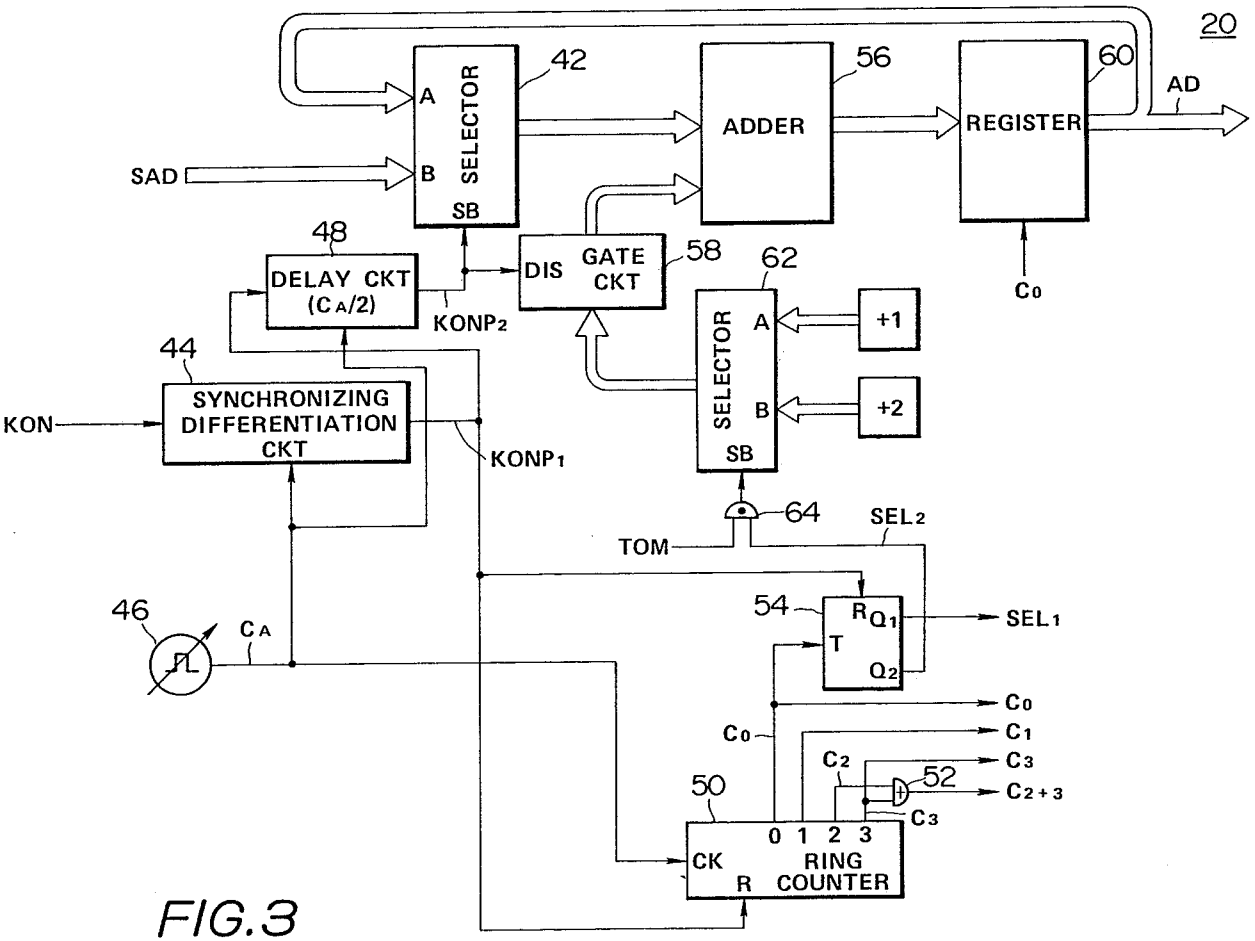
FIG. 3 is a block diagram showing an address generator provided in the apparatus shown in FIG. 2.

In FIG. 3, the start address data SAD are supplied to an input terminal B of a selector 42 within the address generator 20, and the key-on signal KON is supplied to a synchronizing differentiation circuit 44. A clock source 46, which can vary the clock frequency thereof, generates and outputs a clock signal $C_A$ to the synchronizing differentiation circuit 44, a delay circuit 48 and a ring counter 50.

The synchronizing differentiation circuit 44 differentiates the key-on signal KON in synchronism with the clock signal $C_A$ so as to output an output pulse $KONP_1$ having a pulse width corresponding to one cycle of the clock signal $C_A$. This output pulse $KONP_1$ resets the ring counter 50, hence, the ring counter 50 counts the clock signal $C_A$ after the reset time so as to generate the control signal $C_0$, $C_1$, $C_2$ and $C_3$ shown in FIGS. 4(*c*) to (*f*). The control signals $C_2$ and $C_3$ are supplied to an OR gate 52 wherein the control signal $C_{2+3}$ shown in FIG. 4(*g*) is generated.

In addition, the output pulse $KONP_1$ resets a flip-flop 54, a trigger input terminal T of which is supplied with the control signal $C_0$. Hence, the flip-flop 54 outputs control signals $SEL_1$ and $SEL_2$ shown in FIGS. 4(*h*) and 4(*i*) respectively from output terminals $Q_1$ and $Q_2$ thereof. This control signal $SEL_1$ is outputted as the control signal SEL shown in FIG. 2.

Meanwhile, the output pulse $KONP_1$ is supplied to the delay circuit 48 wherein the output pulse $KONP_1$ is delayed by a half cycle of the clock signal $C_A$ (shown by a cycle $C_A/2$ in FIG. 3). Hence, the delay circuit 48 outputs an output pulse $KONP_2$ (shown by a dotted line in FIG. 4(*a*)) to the selector 42 as a selecting signal SB.

The selector 42 selects the input terminal B and outputs the start address data SAD to an adder 56 when the value of the selecting signal SB is "1". The delayed output pulse $KONP_2$ is supplied to the gate circuit 58 as a disable signal DIS, whereby the gate circuit 58 is turned off. In this case, the value of the start address data SAD from the selector 42 is not changed in an adder 56, and the start address data SAD are supplied to a register 60 via the adder 56. Then the start address data SAD are loaded in the register 60 at the timing of the control signal $C_0$. As shown in FIG. 4(*k*), the start address data SAD (shown by data SAD+0) are outputted from the register 60 as the address data AD in a first period (between times $t_0$ and $t_2$) and this start address data SAD are supplied to the input terminal A of the selector 42. The time base of the timing charts shown in FIGS. 4(*j*) and 4(*k*) are shown as four times of the time base of the timing charts shown in FIGS. 4(*a*) to 4(*i*).

Meanwhile, a selector 62 receives an output signal of an AND gate 64, which is supplied with the tom-tone selecting signal TOM and the control signal $SEL_2$, as a selecting signal SB. In addition, data having a value of "+1" (data "+1") and data having a value of "+2" (data "+2") are supplied to respective input terminals A and B of the selector 62. The selector 62 selects the input terminal A and outputs the data "+1" to the gate circuit 58 when the selecting signal SB has the value "0". On the other hand, the selector 62 selects the input terminal B and outputs the data "+2" to the gate circuit 58 when the selecting signal SB has the value "1". In the above first period when the value of the control signal $SEL_2$ is "0" after the delayed output pulse $KONP_2$ is generated from the delay circuit 48, the value of the selecting signal SB is "0" and the selector 62 selects and outputs the data "+1" to the gate circuit 58.

At a time $t_1$ when the value of the delayed output pulse $KONP_2$ becomes "0", the selector 42 selects the input terminal A and outputs the start address data SAD (supplied from the register 60) to the adder 56. At this time, the gate circuit 58 is turned on, hence, the output data "+1" from the selector 62 is passed through the gate circuit 58 and supplied to the adder 56 wherein the data "+1" is added with the start address data SAD. Therefore, the adder 56 outputs data SAD+1 to the register 60 wherein the data SAD+1 are loaded therein at a timing of the control signal $C_0$. As a result, the register 60 outputs the data SAD+1 at a time $t_2$ when the value of the control signal $SEL_2$ shown in FIG. 4(*j*) changes from "0" to "1". Hence, the register 60 outputs the data SAD+1 in a second period between times $t_2$ and $t_3$.

After the time $t_3$, the output data of the register 60 differs depending on the case where the value of the tom-tone selecting signal TOM is "1" or "0". In the case where the value of the tom-tone selecting signal TOM is "1", the selector 62 selects and outputs the data "+2" at every time when the value of the control signal $SEL_2$ becomes "1" as shown in FIG. 4(*j*). Thus, as shown in FIG. 4(*k*), the register 60 sequentially outputs the data SAD+3, SAD+4, SAD+61 , . . . at every periods.

Figure 4:
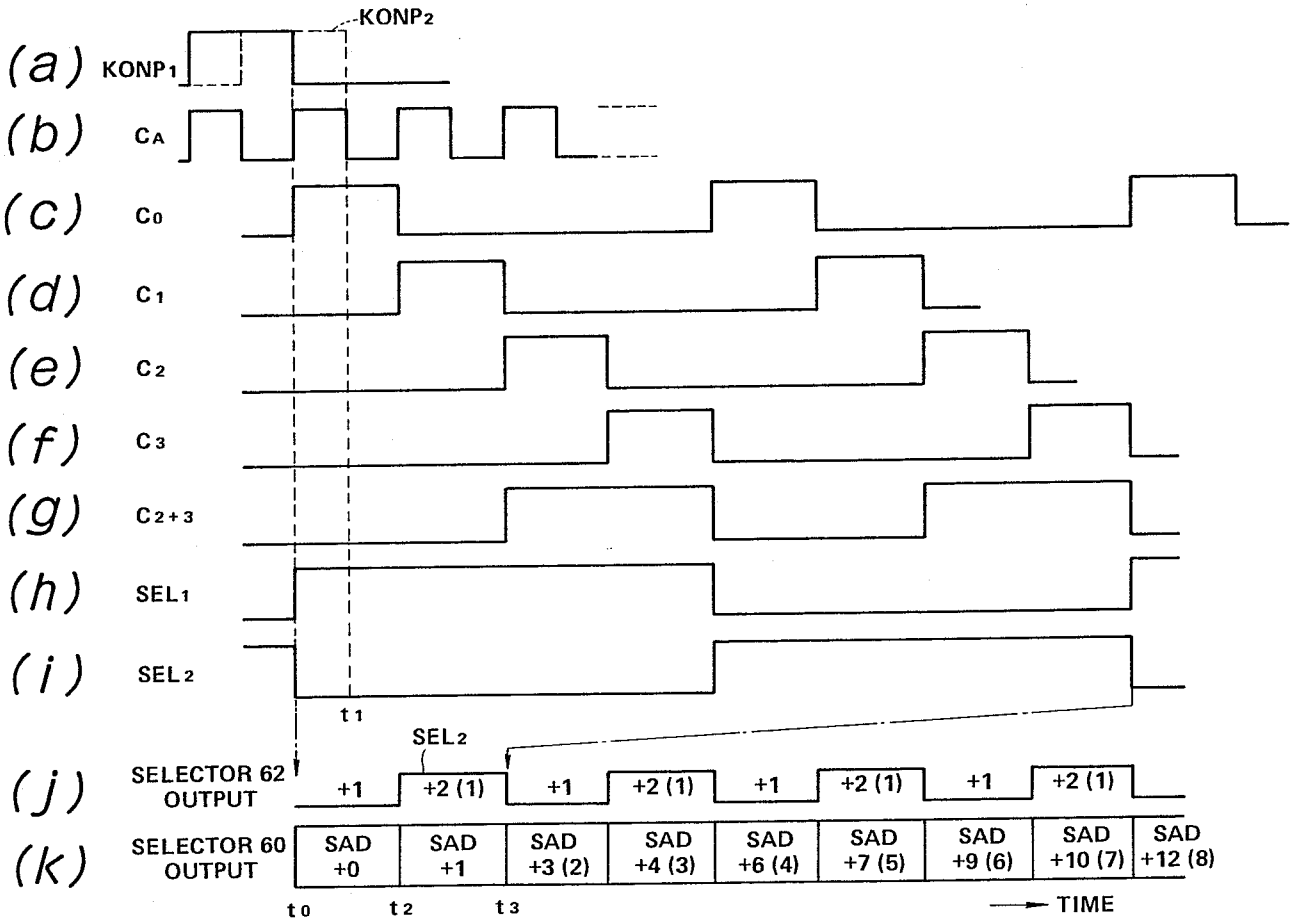
FIGS. 4(*a*) to (*k*) are timing charts for explaining an operation of the address generator shown in FIG. 3.

On the contrary, in the case where the value of the tom-tone selecting signal TOM is "0", the selector 62 always selects and outputs the data "+1", as shown by (1) in FIG. 4(*j*), even when the value of the control signal $SEL_2$ is "1". As a result, the register 60 sequentially outputs the data SAD+2, SAD+3, SAD+4, . . . at every periods.

Figure 5:
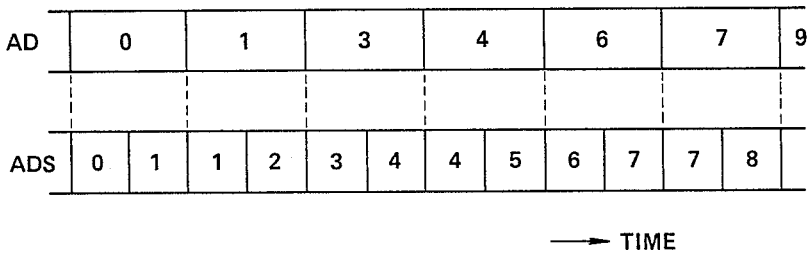
FIG. 5 is a timing chart for explaining an operation of an adder provided in the apparatus shown in FIG. 2.

The output data of the register 60 are supplied to the adder 22 (shown in FIG. 2) as the address data AD. In this case, the adder 22 outputs the address data ADS as the address data AD when the value of the signal TOM is "0". On the other hand, the adder 22 performs the addition operation when the value of the signal TOM is "1" as shown in FIG. 5. FIG. 5 shows the address data AD and ADS by omitting the start address data SAD therefrom. More specifically, the data AD the value of which sequentially varies as "0", "1", "3", "4", "6", "7", . . . are supplied to the adder 22 wherein the data AD are added with the data "1" at a timing of the control signal $C_{2+3}$. As a result, the adder 22 outputs the data ADS, the value of which sequentially varies as "0", "1", "1", "2", "3", "4", "4", "5", "6", "7", "7", . . . at a timing of the control signal $C_{2+3}$.

Incidentally, when the waveform data are read out from the waveform memory 14 in response to the address data ADS so as to generate tones, the tone pitches of the generated tones are determined based on a read-out speed corresponding to the frequency of the clock signal $C_A$. Therefore, it is possible to control the tone pitches by changing the frequency of the clock signal $C_A$ according to needs.

Next, description will be given with respect to the process for outputting the amplitude data of eight bits or twelve bits, which are obtained by latching the output data of the waveform memory 14 shown in FIG. 2, in conjunction with FIG. 6.

The selector 26 outputs the first latch signal L1 which is obtained by selecting pulses $P_{11}$ and $P_{31}$ (shown by hatching in FIG. 6) respectively from the control signals $C_1$ and $C_3$ and disposing the selected pulses $P_{11}$ and $P_{31}$ into one pulse train. Similarly, the selector 26 outputs the second latch signal L2 which is obtained by selecting pulses $P_{12}$ and $P_{32}$ (which are different from the pulses $P_{11}$ and $P_{31}$ in respective control signal $C_1$ and $C_3$) and disposing the selected pulses $P_{12}$ and $P_{32}$ into one pulse train.

Figure 6:
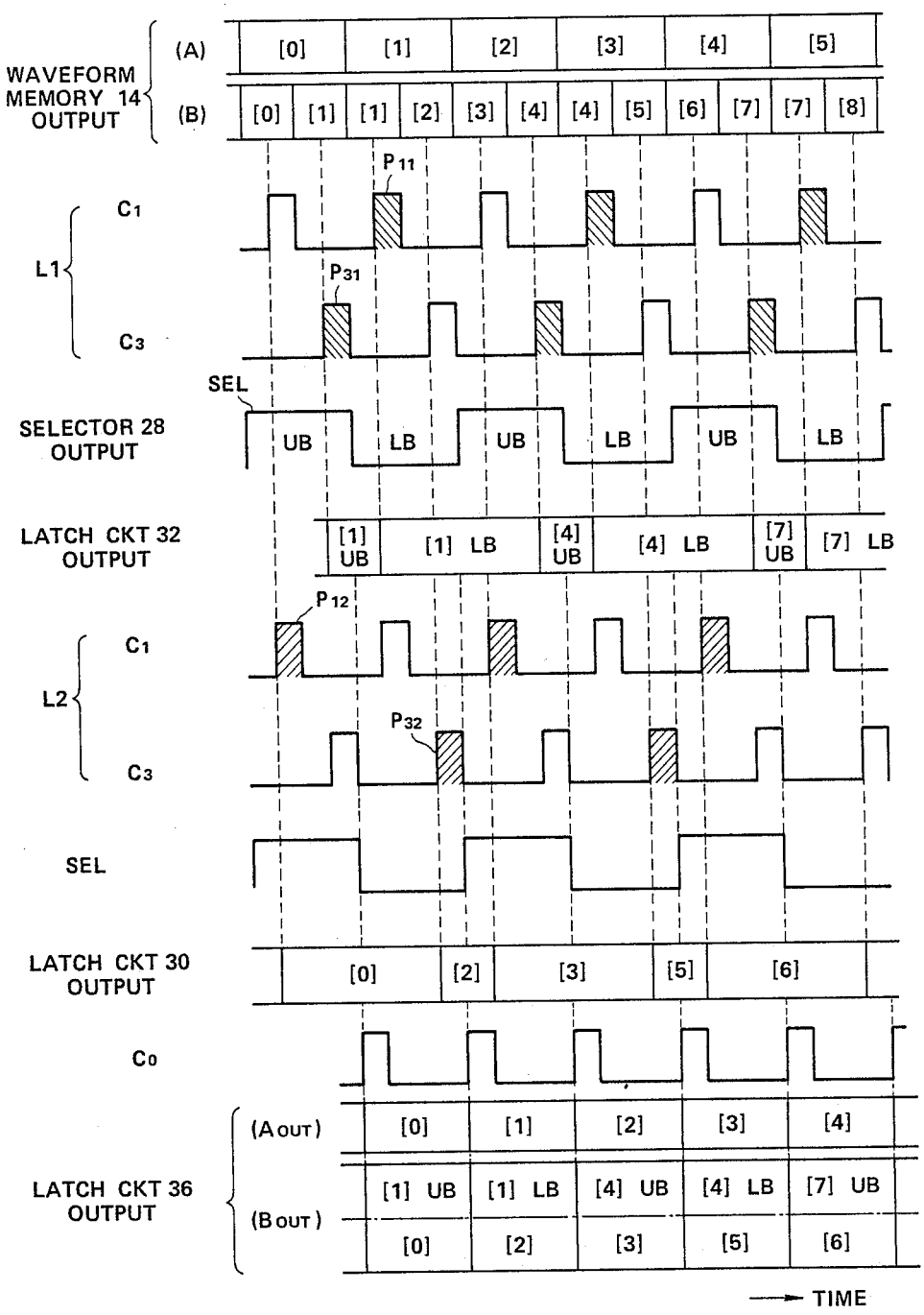
FIG. 6 is a timing chart for explaining a latch operation of a waveform memory provided in the apparatus shown in FIG. 2.

In the case where the non-tom waveform data are read out from the waveform memory 14 ( which includes the case where the noisy tom-tone waveform data are read out from the waveform memory 14 as shown in FIG. 1), the waveform memory 14 sequentially outputs the data [0] of the address "0", the data [1] of the address "1", the data [2] of the address "2", . . . based on the address data ADS as shown by (A) in FIG. 6. On the other hand, in the case where the tom-tone waveform data are read out from the waveform memory 14, the waveform memory 14 sequentially outputs the data [0], [1], [1], [2], [3], [4], [4], . . . based on the address data ADS as shown in FIG. 6 by (B).

More specifically, in the case where the non-tom waveform data are read out from the waveform memory 14, the gate circuit 34 is turned off, hence, the waveform memory 14 outputs the amplitude data of eight bits to the DAC 38 via the latch circuits 30 and 36 in series. In this case, the data [0]shown by (A) in FIG. 6 are latched in the latch circuit 30 in response to the pulse $P_{12}$ of the latch signal L2. This output data [0] of the latch circuit 30 are latched in the latch circuit 36 at the timing of the control signal $C_0$. Next, the data [1] shown by (A) in FIG. 6 are latched in the latch circuit 30 in response to the pulse $P_{32}$ of the signal L2, and the latched output data [1] of the latch circuit 30 are latched in the latch circuit 36 at the timing of the control signal $C_0$. Thereafter, the same latch operation is repeatedly performed. As a result, the latch circuit 36 outputs the amplitude data of eight bits, which sequentially varies such as [0], [1], [2], [3], . . . as shown by ($A_{OUT}$) in FIG. 6.

On the other hand, in the case where the tom-tone waveform data are read out from the waveform memory 14, the gate circuit 34 is turned off depending on the value of the tom-tone selecting signal TOM. Hence, the latch circuit 36 outputs the amplitude data of twelve bits.

More specifically, the selector 28 (which responses to the control signal SEL) selects the upper data UB of four bits in a period when the output data of the waveform memory 14 represent the data [0] and [1] shown by (B) in FIG. 6. In addition, the selector 28 selects the lower data LB of four bits in a period when the output data of the waveform memory 14 represent the data [1]and [2]shown in FIG. 6 by (B). For this reason, the upper data [1]UB of four bits within the data [1] are latched in the latch circuit 32 in response to the pulse $P_{31}$ of the first latch signal L1. Next, the lower data [1]LB of four bits within the data [1] are latched in the latched circuit 32 in response to the pulse $P_{11}$ of the first latch signal L1. Similarly, the data [4]UB, [4]LB, [7]UB, [7]LB, . . . are sequentially latched in the latch circuit 32.

In parallel with the above latch operation of the latch circuit 32, the data [0] are latched in the latch circuit 30 in response to the pulse $P_{12}$ of the second latch signal L2. Next, the data [2] are latched in the latch circuit 30 in response to the pulse $P_{32}$ of the second latch signal L2. Similarly, the data [3], [5], [6], . . . are sequentially latched in the latch circuit 30.

In parallel with the latch operations of the latch circuits 30 and 32 described heretofore, both output data of the latch circuits 30 and 32 are latched in the latch circuit 36 in response to the control signal $C_0$. As a result, the latch circuit 36 sequentially outputs the amplitude data of twelve bits as shown by ($B_{OUT}$) in FIG. 6. More specifically, the output data of the latch circuit 36 sequentially represent the data [0] plus [1]UB, the data 2 plus [1]L,, the data [3] plus [4]UB, the data [5] plus [4]LB, . . . It is obvious that the above output data of the latch circuit 36 are identical to the data of twelve bits shown in the middle part of FIG. 1.

Above is the description of a preferred embodiment of the present invention. This invention may be practiced or embodied in still other ways without departing from the spirit or essential character thereof. For instance, one rhythm tone is generated at one tone generating timing in the present embodiment, however, it is possible to employ a time division multiplex system and simultaneously generate plural tones at the same time. In addition, the rhythm performance is played by the manual operation in the present embodiment, however, it is possible to provide a rhythm pattern memory and thereby control the read-out operation of the waveform memory in accordance with the rhythm pattern prestored in the rhythm pattern memory. In this case, it is possible to automatically play the rhythm performance. Furthermore, one sampling bit number M is not limited to twelve bits, and one word bit number N of the waveform memory 14 is not limited to eight bits. In this case, there is a relation between the above bit numbers M and N for the efficient utilization of the waveform memory 14, i.e., $N<M\leqq 1.5N$. And the subject matter of the memory 14, i.e., N present invention is that the data storing format is determined such that the amplitude data of two sampling points are stored in every three storing areas of the waveform memory. Hence, any combination between the bit numbers M and N can be selected within the meaning of the above relation. Plus, when the bit numbers M and N are set as $N=2(M-N)$ (e.g., when M equals to twelve and N equals to eight), the unused storing areas can be eliminated and the utilization efficiency of the waveform memory reaches 100%. Therefore, the preferred embodiment described herein is illustrative and not restrictive, the scope of the invention being indicated by the appended claims and all variations which come within the meaning of the claims are intended to be embraced therein.

What is claimed is:

1. An apparatus for pre-storing a plurality of amplitude data corresponding to the amplitude of a tone waveform at a plurality of sampling points and generating tones corresponding to the stored amplitude data, said apparatus comprising:

(a) waveform memory means for storing amplitude data of M bits (where M denotes an integral number) based on a predetermined data storing format, said waveform memory means comprising a plurality of one-word storing areas each of which is constructed by N-bit storing positions (where N denotes an integral number and sets as $N<M\leqq 1.5N$);

(b) address supplying means for supplying addresses indicating each of said one-word storing areas in a predetermined order to save waveform memory means, so that new amplitude data of N bits are read out based on said amplitude data of M bits; and (c) tone generating means for generating a tone corresponding to said new amplitude data.

2. An apparatus according to claim 1, wherein said predetermined data storing format is determined such that said amplitude data of two sampling points are stored in three of said one-word storing areas, said three one-word storing areas are arranged such that first to third one-word storing areas are disposed adjacent to each other, one data of lower N bits within one amplitude data of M bits being stored in said first one-word storing area and other data of lower N bits within other amplitude data of M bits are stored in said third one-word storing area, one remained data of (M-N) bits within said one amplitude data of M bits and other remained data of (M-N) bits within said other amplitude data of M bits being stored in said second one-word storing area which is arranged between said first and third one-word storing areas.

3. An apparatus according to claim 1 further being capable of reading out said amplitude data of M bits in such an order that said one data of N bits read out from said first one-word storing area and said one remained data of (M-N) bits read out from said second one-word storing area are combined together to thereby reproduce said one amplitude data of M bits and that said other data of N bits read out from said third oneword storing area and said other remained data of (M-N) bits read out from said second one-word storing area are combined together to thereby reproduce a tone corresponding said amplitude data of M bits.

4. An apparatus according to claim 3 further comprising reproducing means which comprises:

(a) first read-out means for reading out said word data of N bits from said first or third one-word storing area;

(b) second read-out means for reading out remaining data of (M-N) bits corresponding to said word data read out by said first read-out means from said second one-word storing area; and (c) combining means for combining said word data from said first read-out means and corresponding remaining data from said second read-out means to thereby reproduce said amplitude data of M bits at each sampling point.

5. An apparatus for pre-storing a plurality of amplitude data corresponding to the amplitude of a tone waveform at a plurality of sampling points and generating tones corresponding to the stored amplitude data, said aparatus comprising:

(a) waveform memory means for storing amplitude data of M bits (where M denotes an integral number) based on a predetermined data storing format, said waveform memory means including a plurality of storing areas each of which stores data of N bit storing positions (where N denotes an integral number and sets as $N<M\leqq 1.5N$) as one word;

(b) selecting means for selecting one of a first tone corresponding to said tone waveform stored in said waveform memory means and a second tone corresponding to a tone different from said tone waveform;

(c) address generating means for generating a first address when said selecting means select said first tone and generating a second address when said selecting means select second tone; and (d) tone generating means for generating selected first or second tone, said tone generating means reading out word data of N bits from each storing area of said waveform memory means based on said first address and reproducing said amplitude data of M bits at each sampling point by use of a plurality of said word data so as to generate said first tone corresponding to reproduced amplitude data when said selecting means select said first tone, said tone generating means reading out said word data of N bits from each storing area of said waveform memory means based on said second address so as to generate said second tone by use of said word data when said selecting means select said second tone.

6. An apparatus according to claim 5, wherein said predetermined data storing format is determined such that said amplitude data of two sampling points are stored in three storing areas, said three storing areas being arranged within said waveform memory means such that first to third storing areas are disposed adjacent to each other, one data of N bits within one amplitude data of M bits being stored in said first storing area and other data of N bits within other amplitude data of M bits being stored in said third storing area, one remained data of $(M-N)$ bits within said one amplitude data of M bits and other remained data of $(M-N)$ bits within said other amplitude data of M bits being stored in said second storing area which is arranged between said first and third storing areas.

7. An apparatus according to claim 6, wherein said amplitude data of two sampling points are reproduced based on said first address in such a manner that said one data of N bits read out from said first storing area and said one remained data of (M N) bits read out from said second storing area are combined together to thereby reproduce said one amplitude data of M bits, and further said other data of N bits read out from said third storing area and said other remained data of $(M-N)$ bits read out from said second storing area are combined together to thereby reproduce said other amplitude data of M bits when said selecting means select said first tone, said one and other amplitude data being sequentially outputted so that said first tone is generated.

8. An apparatus according to claim 7, wherein said second tone is generated based on said second address in such a manner that data stored in each storing area are sequentially read out from said waveform memory means and said second tone is generated based on the read data when said selecting means select said second tone.

9. An apparatus according to claim 1 or 5, wherein said M equals to twelve and said N equals to eight.

* * * * *